US005322433A

United States Patent [19]

Shike et al.

[11] Patent Number: 5,322,433

[45] Date of Patent: Jun. 21, 1994

[54] IGNITING DEVICE

[75] Inventors: Tsutomu Shike; Toshihiko Eguchi; Masaki Saito, all of Shimohara, Japan

[73] Assignee: Tokai Corporation, Japan

[21] Appl. No.: 910,165

[22] PCT Filed: Nov. 29, 1991

[86] PCT No.: PCT/JP91/01665

§ 371 Date: Sep. 3, 1992

§ 102(e) Date: Sep. 3, 1992

[87] PCT Pub. No.: WO92/09851

PCT Pub. Date: Nov. 6, 1992

[30] Foreign Application Priority Data

Nov. 25, 1991 [JP] Japan ..... 3-96547
Nov. 25, 1991 [JP] Japan ..... 3-96548

[51] Int. Cl.[5] ..... F23Q 3/01; F23D 14/28
[52] U.S. Cl. ..... 431/266; 431/344
[58] Field of Search ..... 431/255, 266, 344

[56] References Cited

U.S. PATENT DOCUMENTS

| | | | |
|---|---|---|---|
| 2,888,066 | 5/1959 | Wilson | 431/255 |
| 3,071,182 | 1/1963 | Delano | 431/266 X |
| 3,155,140 | 11/1964 | Wilson | 431/266 X |
| 3,431,058 | 3/1969 | Hufferd | 431/266 X |
| 3,558,251 | 1/1971 | Bauger et al. | 431/266 |
| 3,694,134 | 9/1972 | Ross | 431/255 |
| 3,947,731 | 3/1976 | Vainer | 431/255 X |
| 4,881,894 | 11/1989 | Chapin et al. | 431/255 X |

*Primary Examiner*—Carl D. Price
*Attorney, Agent, or Firm*—Brumbaugh, Graves, Donohue & Raymond

[57] ABSTRACT

An igniting device has a gas reservoir 7, a valve mechanism 8, and a gas pipe 28 for leading fuel gas to a gas injection nozzle 26. A piezoelectric unit 20 generates a discharge voltage for producing an electric spark between the gas injection nozzle 26 and a discharge electrode 32 which is disposed near the gas injection nozzle. A covered wire 33 for electrically connecting the nozzle 26 with the piezoelectric unit 20 extends through the gas pipe 28 to reduce the effective cross-sectional area of the gas passage inside the gas pipe 28 with a high reliability and ease.

2 Claims, 5 Drawing Sheets

IGNITING DEVICE

FIELD OF THE INVENTION

This invention relates to an igniting device which injects flame from a nozzle by igniting fuel gas discharged from a built-in gas reservoir.

BACKGROUND OF THE INVENTION

In an igniting device such as an igniting rod or a table gas lighter, flame is injected from a tip of a rod-like portion which projects from a valve mechanism which controls gas supply from a gas reservoir. A gas pipe for supplying fuel gas to a fuel nozzle on the tip of the rod-like portion and a wire for supplying a discharge voltage for producing spark extend from the body portion and respectively connected to the fuel nozzle and a discharge electrode on the tip of the rod-like portion.

In such an igniting device, misfire is apt to occur due to delay in discharge of fuel gas.

That is, when the gas pipe is long, it takes certain time for the fuel gas discharged from the gas reservoir to reach the nozzle after the valve mechanism is opened, and accordingly, if the piezoelectric unit is actuated simultaneously with opening of the valve mechanism, the fuel gas cannot be surely ignited. In order to overcome this problem, conventionally, the piezoelectric unit is arranged to be actuated a certain time after opening of the valve mechanism in response to depression of an ignition lever. However since the lever depressing speed varies from person to person, the spark is sometimes produced before the fuel gas reaches the nozzle and sometimes produced after a large amount of fuel gas is discharged from the nozzle, and conventionally, it has been difficult to steadily ignite the fuel gas.

The time required for the fuel gas to reach the nozzle can be shortened by increasing the flow speed of the gas through the gas pipe by reducing the inner diameter of the gas pipe. However, the gas pipe having a small inner diameter is difficult to connect and is not preferable from the viewpoint of production.

Further when the wire for electrically connecting the nozzle and the piezoelectric unit is long, there is produced a large stray capacitance between the wire and the ground, and the discharge voltage which is generated by the piezoelectric unit and is an alternating voltage leaks to the ground through the stray capacitance, whereby the spark produced by the discharge voltage is weakened and the fuel gas sometimes cannot be ignited.

In view of the foregoing observations and description, the primary object of the present invention is to provide an igniting device in which the gas passage to the nozzle can be small in the effective cross-sectional area with a high reliability and a simple structure and the fuel gas can be steadily ignited.

DISCLOSURE OF THE INVENTION

In accordance with the present invention, a covered wire which electrically connects a piezoelectric unit and a fuel nozzle is passed through a gas pipe for supplying fuel gas to the fuel nozzle, thereby reducing the effective cross-sectional area of the gas passage inside the gas pipe.

In a preferred embodiment of the present invention, the covered wire is passed through the gas pipe to extend along the longitudinal axis of the gas pipe.

With this arrangement, the effective cross-sectional area of the gas passage can be easily reduced and the flowing speed of the fuel flowing through the gas passage can be increased without reducing the inner diameter of the gas pipe itself. Since the inner diameter of the gas pipe need not be reduced, the gas pipe can be easily produced with a high reliability and the gas pipe can be easily connected to the parts associated therewith.

When the covered wire extends along the longitudinal axis of the gas pipe, the distance between the covered wire and the ground is enlarged and the stray capacitance is minimized, whereby leak of the discharge voltage can be minimized.

PREFERRED EMBODIMENT OF THE INVENTION

Figure 1:
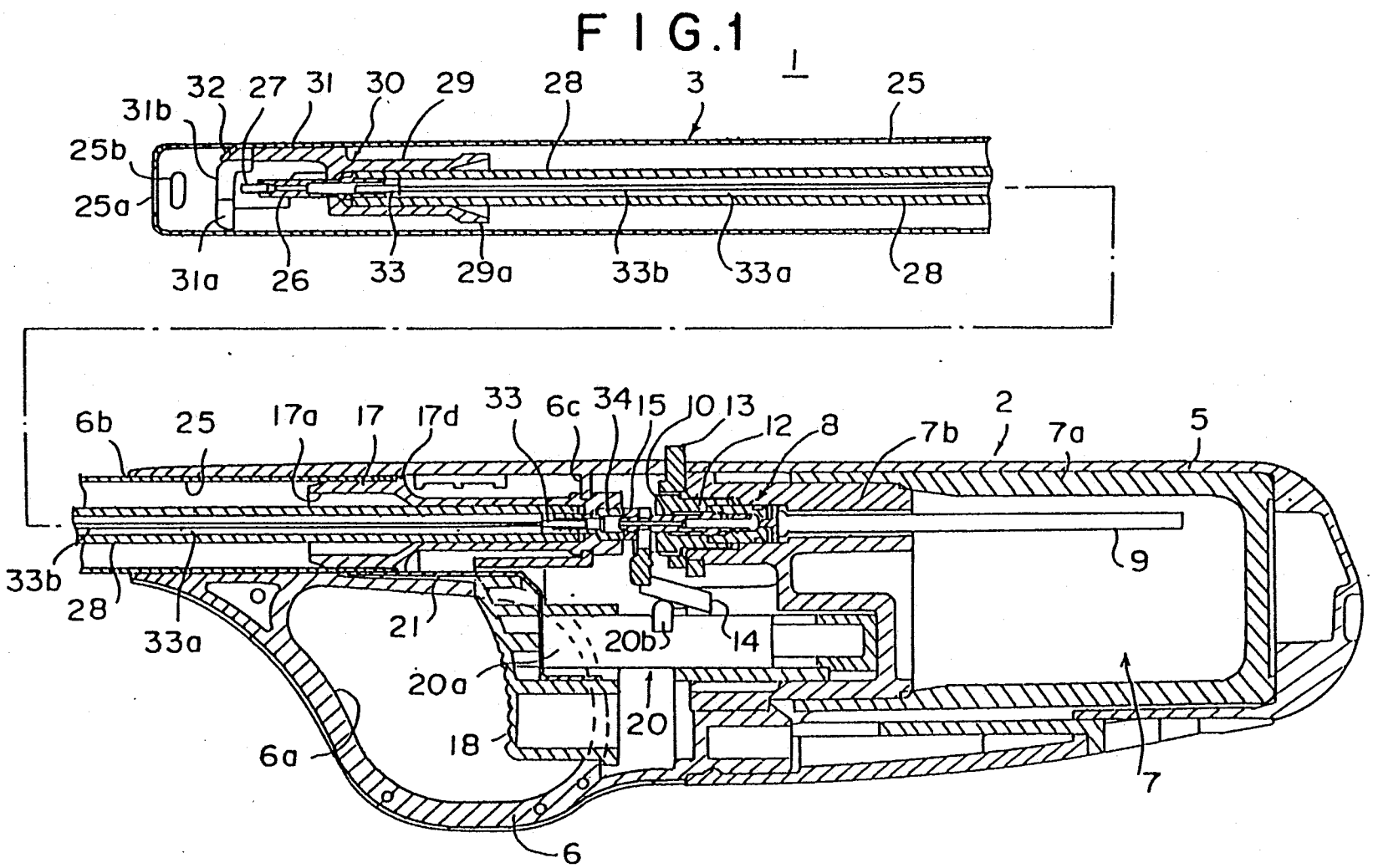
FIG. 1 is a vertical cross-sectional view of an igniting rod in accordance with an embodiment of the present invention.
Figure 2:
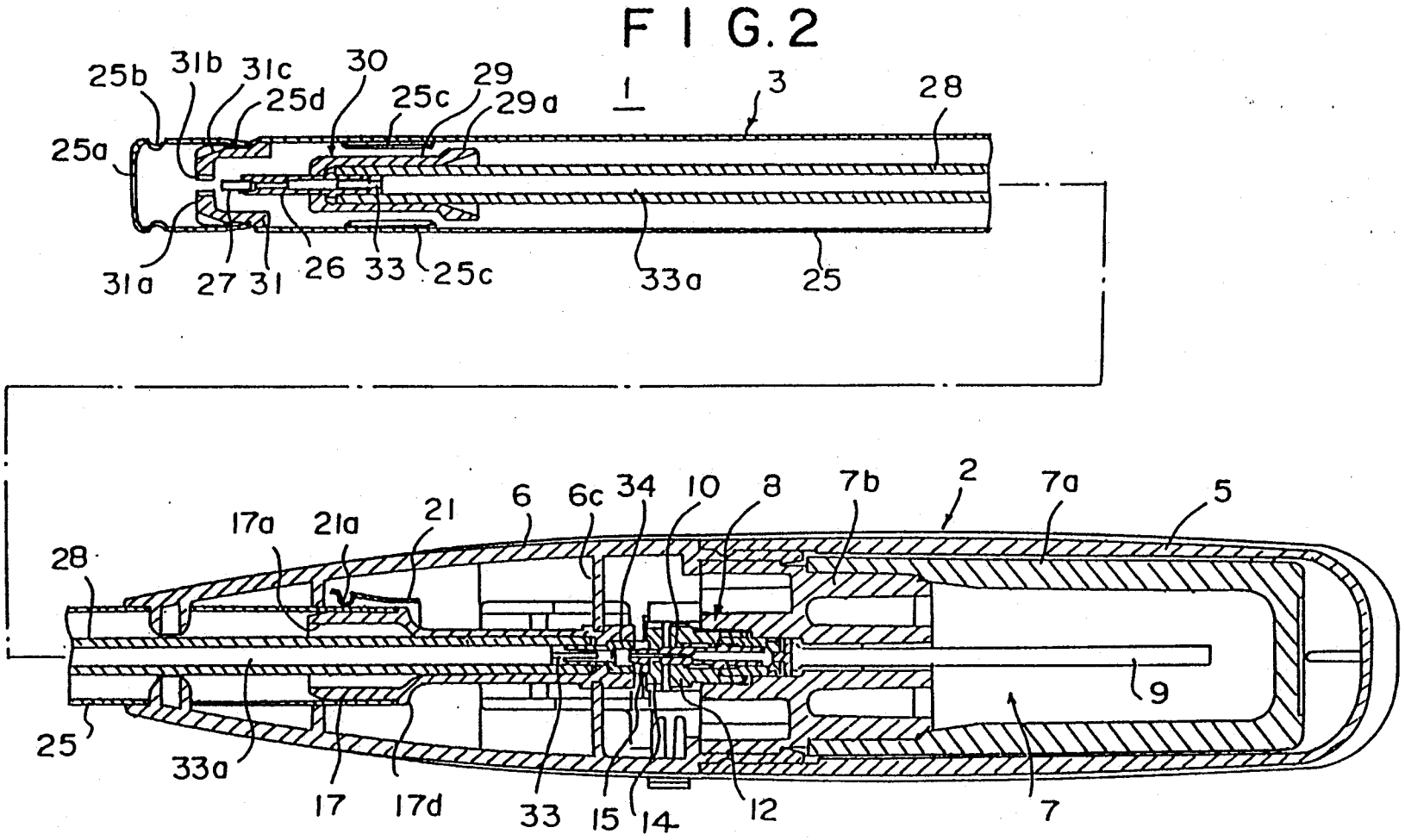
FIG. 2 is a horizontal cross-sectional view of the same.
Figure 3:
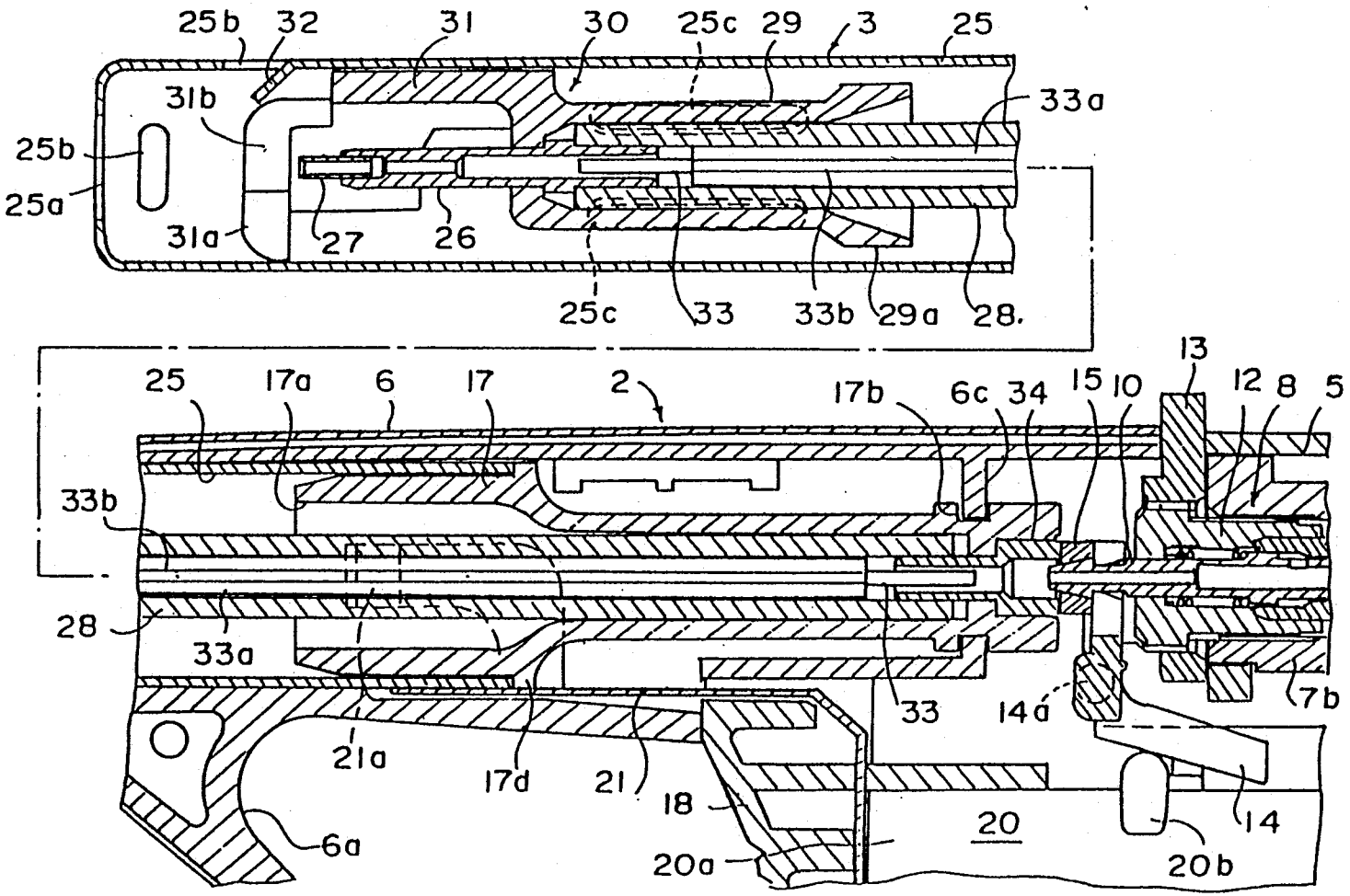
FIG. 3 is an enlarged view of a part of Figure 1.

Embodiments of the present invention will be described with reference to the drawings, hereinbelow. FIG. 1 is a cross-sectional view of an igniting rod in accordance with an embodiment of the present invention, FIG. 2 is a horizontal cross-sectional view of the same, and FIG. 3 is an enlarged view of a part of FIG. 1.

The igniting device 1 comprises a body portion 2 and a rod portion 3 extending from the body portion 2. In this particular embodiment, the body portion 2 and the rod portion 3 are in the form of separate units which are integrated into the igniting device 1.

The body portion 2 has a casing comprising a reservoir cover 5 and an intermediate casing 6 disposed in front of the reservoir cover 5. The reservoir cover 5 is in the form a tubular member open at the front end, and the intermediate casing 6 comprising left and right halves. The intermediate casing 6 has an opening *6a* for accommodating an ignition lever in the lower portion thereof and an opening *6b* in the front end thereof through which the rod portion 3 is received in the body portion 2 and connected thereto.

A gas reservoir 7 in which pressurized fuel gas is stored is accommodated i the reservoir cover 5. The gas reservoir 7 comprises a reservoir body *7a* and an upper lid *7b* connected to the reservoir body *7a*. A valve mechanism 8 for controlling gas supply from the gas reservoir 7 is provided in the upper lid *7b*. That is, a wick 9 is inserted into the gas reservoir 7 and the fuel gas is supplied through the wick 9 and a nozzle member 10 is disposed in the gas supply passage. The nozzle member 10 is urged rearward by a spring, and when the nozzle member 10 is moved forward, the gas supply passage is opened and the fuel gas is supplied, and when the nozzle member 10 is returned rearward under the force of the spring, the gas supply passage is closed and gas supply is interrupted. The amount of gas supply or the size of the flame is adjusted by rotating a flame adjustment knob 13 which is connected to an adjustment sleeve 12 and projects outward.

One end of a lever 14 for opening the nozzle member 10, i.e., for moving forward the nozzle member 10, is engaged with a front end portion of the nozzle member 10. A sealed packing 15 is mounted on the tip of the nozzle member 10 forward of the lever 14. The other end portion of the lever 14 is connected to a piezoelectric unit 20 which will be described later.

An ignition lever 18 is mounted inside the opening 6a of the intermediate casing 6 to be slidable back and forth. The piezoelectric unit 20 is provided between the the ignition lever 18 and the upper lid 7b of the gas reservoir 7. The piezoelectric unit 20 is for supplying discharge voltage, and when the ignition lever 18 is pulled rearward, a sliding portion 20a is moved rearward to cause a projection 20b to engage with the lever 14 and rotate it and discharge voltage generated in the piezoelectric unit 20 is supplied.

That is, the lever 14 is L-shaped and is supported to rotate about a pivot 14a. When said the other end of the lever 14 is rotated upward in response to the rearward movement of the projection 20b of the sliding portion 20a, said one end of the lever 14 pulls forward the nozzle member 10 to open the gas supply passage. The projection 20b doubles as one terminal for the discharge voltage and is electrically connected to the nozzle member 10 through the lever 14 which is made of conductive resin.

The sliding member 20a of the piezoelectric unit 20 doubles as the other terminal for the discharge voltage and is electrically connected to a contact 21a by way of an earth plate 21. The contact 21a is disposed beside an intermediate portion of a pipe holder 17 which will be described later. That is, the earth plate 21 is sandwiched between the piezoelectric unit 20 and the ignition lever 18 at its base portion, is bent forward above the ignition lever 18, and then is cranked at portion near a flange portion 17d of the pipe holder 17. The front end of the earth plate 21 is formed into the contact 21a which is disposed on one side of the central axis of the pipe holder 17 and is pressed against the pipe holder 17 toward the central axis thereof. The earth plate 21 is moved in response to slide of the ignition lever 18.

The rod portion 3 comprises a metal tubular member 25 and a gas injection nozzle 26 which is mounted in the front end of the tubular member 25. The gas injection nozzle 26 has a nozzle tip 27 on its front end and is fitted on the front end of a gas pipe 28 at its rear end. A nozzle cover 30 is mounted on the gas injection nozzle 26 to surround it. The nozzle cover 30 is made of dielectric material such as plastics and has holder portion 29 which is fitted on the gas injection nozzle 26 and the front end portion of the gas pipe 28. The holder portion 29 has a flared rear end portion 29a which is square in cross-section and positioned coaxially with the tubular member 25 in contact with the inner surface of the tubular member 25.

The nozzle cover 30 is further provided with a cover portion 31 which is connected to an upper portion of the holder portion 29 and extends forward therefrom. The front end portion of the gas injection nozzle 26 projects forward from the holder portion 29 and the cover portion 31 surrounds the front end portion of the gas injection nozzle 26 at a predetermined distance therefrom except a lower portion of the gas injection nozzle 26. The cover portion 31 has a front wall portion 31a which extends inward in a position forwardly distant from the tip of the nozzle tip 27. The front wall portion 31a is cut away to form a V-shaped opening 31b which is flared upward from a portion substantially aligned with the nozzle tip 27. As shown in FIGS. 2 and 3, the opening 31b extends inward of the cover portion 31 on the side of a discharge electrode to such an extent that the nozzle tip 27 is exposed so that fuel gas is surely ignited.

Further, the opening 31b is extended downward in a slit-like form, thereby dividing the front wall portion 31a in two sectors opposed to each other as viewed from the front. A pair of engagement grooves 31c are formed on opposite sides of the cover portion 31 and are engaged with engagement pieces 25d of the tubular member 25 which are bent inward.

The tubular member 25 has a front end wall and a flame port 25a through which flame is injected outward is formed in the central portion of the front end wall. A plurality of air intake ports 25b are formed in the tubular member 25 behind the flame port 25a. Further, a part of the tubular member 25 is bent inward behind the air intake ports 25b to form a discharge electrode 32. The portion of the tubular member 25 at which the discharge electrode 32 is formed forms another air intake port 25b. Further four elongated air intake ports 25c are formed in the tubular member 25 to extend in the longitudinal direction of the tubular member 25 at portions opposed to the holder portion 29 of the nozzle cover 30.

The nozzle cover 30 is accommodated in the tubular member 25 so that the discharge electrode 32 is positioned above the V-shaped opening 31a thereof. Air introduced into the inside of the tubular member 25 through the air intake ports 25c formed around the holder portion 29 of the nozzle cover 30 flows into the space in the cover portion 31.

The gas pipe 28 the front end portion of which is inserted into the holder portion 29 of the nozzle cover 30 is for leading the fuel gas to the gas injection nozzle 26 and is made of hard material. The gas pipe 28 extends through the tubular member 25 along the central axis thereof and the rear end portion of the gas pipe 28 projects rearward outside the tubular member 25. The front end portion of said pipe holder 17 is fitted in the rear end portion of the tubular member 25 while the rear end portion of the gas pipe 28 is fitted in the front end portion of the pipe holder 17.

Figure 4:
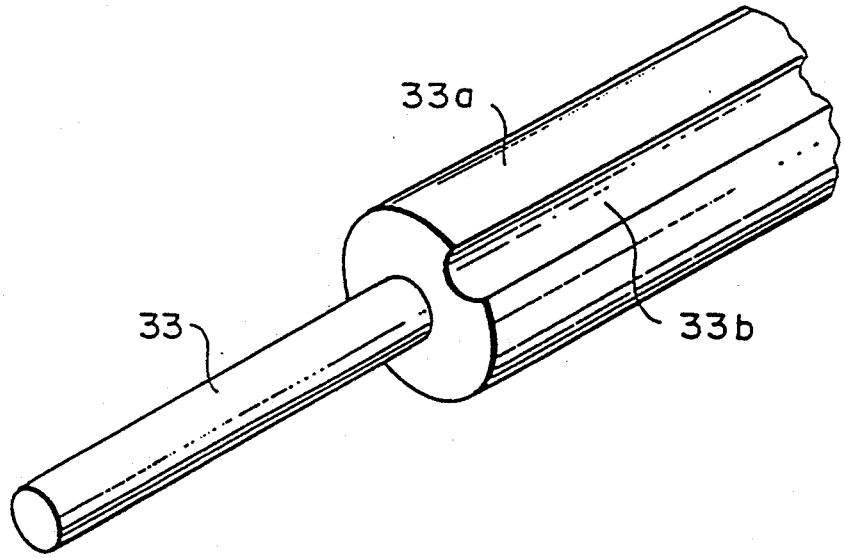
FIG. 4 is an enlarged fragmentary perspective view of the covered wire.

A covered wire 33 having a cover 33a extends through the gas pipe 28 coaxially with the gas pipe 28. The covered wire 33 has an outer diameter slightly smaller than the inner diameter of the gas pipe 28, whereby a gas passage having a small effective cross-sectional area is formed between the outer surface of the covered wire 33 and the inner surface of the gas pipe 28. A groove 33b is formed in the cover 33a of the covered wire 33 to extend in the longitudinal direction thereof as clearly shown in FIG. 4. The cover 33a is removed at front and rear end portions of the covered wire 33 and the core of the covered wire 33 is exposed at the front and rear end portions.

A tubular terminal member 34 is mounted on the rear end portion of the gas pipe 28. That is, the front end portion of the terminal member 34 is fitted in the rear end portion of gas pipe 28 through the rear end of the pipe holder 17, and the rear end portion of the terminal member 34 is flared and fitted in the rear end portion of the pipe holder 17. The rear end portion of the exposed core of the covered wire 33 is connected to the terminal member 34 and the front end portion of the same is connected to the gas injection nozzle 26, whereby the terminal member 34 and the gas injection nozzle 26 are electrically connected by the covered wire 33.

The pipe holder 17 is a tubular member having a longitudinal through hole 17*a* into which the rear end portion of the gas pipe 28 is inserted. The through hole 17*a* has a large diameter at the front end portion and is smoothly tapered rearward to form a guide surface. The pipe holder 17 is further provided with an annular groove 17*b* which is formed on the outer peripheral surface of the rear end portion thereof and is adapted to be engaged with an engagement portion 6*c* formed on the inner surface of the intermediate casing 6. The sealed packing 15 mounted on the tip of the nozzle member 10 of the valve mechanism 8 is adapted to abut against the flared rear end portion of the terminal member 34. The front end portion of the pipe holder 17 is fitted in the rear end portion of the tubular member 25 and the rear end face of the tubular member 25 is in abutment against a flange portion 17*d* formed on the outer surface of the pipe holder 17.

The rod portion 3 is connected to the body portion 2 in the following manner. That is, the pipe holder 17 in which the gas pipe 28 and the tubular member 25 have been incorporated is set to one of the halves of the intermediate casing 6 of the body portion 2 so that the annular groove 17*b* of the pipe holder 17 is engaged with the engagement portion 6*c* of the intermediate casing 6, and then the other half of the intermediate casing 6 is incorporated with said one of the halves.

In the assembled state, the terminal member 34 and the nozzle member 10 are connected, and the gas passage in the gas pipe 28 and the gas passage in the valve mechanism 8 communicate with each other. Further, the contact 21*a* of the earth plate 21 is in contact with the outer surface of the tubular member 25 and the discharge electrode 32 is electrically connected with the piezoelectric unit 20. The gas injection nozzle 26 is electrically connected with the piezoelectric unit 20 by way of the nozzle member 10, the terminal member 34 and the covered wire 33. Since the discharge voltage produced by the piezoelectric unit 20 is high alternating voltage, the discharge voltage can be applied to the nozzle tip 27 even if there is a slight gap between the nozzle member 10 and the terminal member 34 or between the terminal member 34 and the exposed rear end portion of the covered wire 33.

The operation of the igniting rod 1 of this embodiment will be described, hereinbelow. When the ignition lever 18 is pulled rearward, the nozzle member 10 of the valve mechanism 8 is moved forward and the fuel gas is discharged from the gas reservoir 7 as described above. The fuel gas discharged from the gas reservoir 7 is injected from the nozzle tip 27 of the gas injection nozzle 26 through the space in the gas pipe 28 which is narrowed by the covered wire 33 inserted therein. The groove 33*b* formed on the outer surface of the covered wire 33 ensures the gas passage to the gas injection nozzle 26 even when the covered wire 33 is moved in the gas pipe 28 and the front or rear end face of the cover 33*a* is brought into contact with the end of the gas injection nozzle 26 or the terminal member 34.

Since the gas passage in the gas pipe 28 is narrowed as described above, the velocity of the fuel gas flowing therethrough is high and the fuel gas can reach the nozzle tip 27 in a short time after opening of the valve mechanism 8.

Further, in response to operation of the ignition lever 18, the piezoelectric unit 20 produces an alternating discharge voltage which is applied between the discharge electrode 32 and the nozzle tip 27 in the rod portion 3, whereby the fuel gas injected from the nozzle tip 27 is ignited.

Since the fuel gas can be stably supplied to the gas injection nozzle 26 in time by virtue of the narrowed gas passage in the gas pipe 28 and since a part of fuel injected from the nozzle tip 27 dwells in the cover portion 31 and is mixed with air introduced through the air intake ports 25*c*, the fuel gas injected from the nozzle tip 27 can be well ignited by spark produced by the discharge voltage. Further since the covered wire 33 is inserted into the gas pipe 28 at the center of the tubular member 25 which forms the ground, the distance between the ground and the wire 33 is maximized and stray capacitance in discharge of high alternating voltage is minimized, whereby leak is reduced and discharge energy is increased, thereby improving igniting performance of the igniting rod 1.

The nozzle tip 27 is positioned in the cover portion 31 of the nozzle cover 30 and is covered with the nozzle cover 30 and the tubular member 25. Accordingly, wind, oil, fire work or the like which blows off flame cannot directly act on the nozzle tip 27, and the nozzle tip 27 and the gas injection nozzle 26 are protected from foreign matter which can adhere to the nozzle tip 27 and the gas injection nozzle 26 and weaken discharge spark.

Though, in the embodiment described above, the body portion 2 and the rod portion 3 are separately formed and incorporated together later, they may be formed integrally. Further, the gas pipe 28 may be formed of flexible material though preferably it is formed of hard material.

Figure 5:
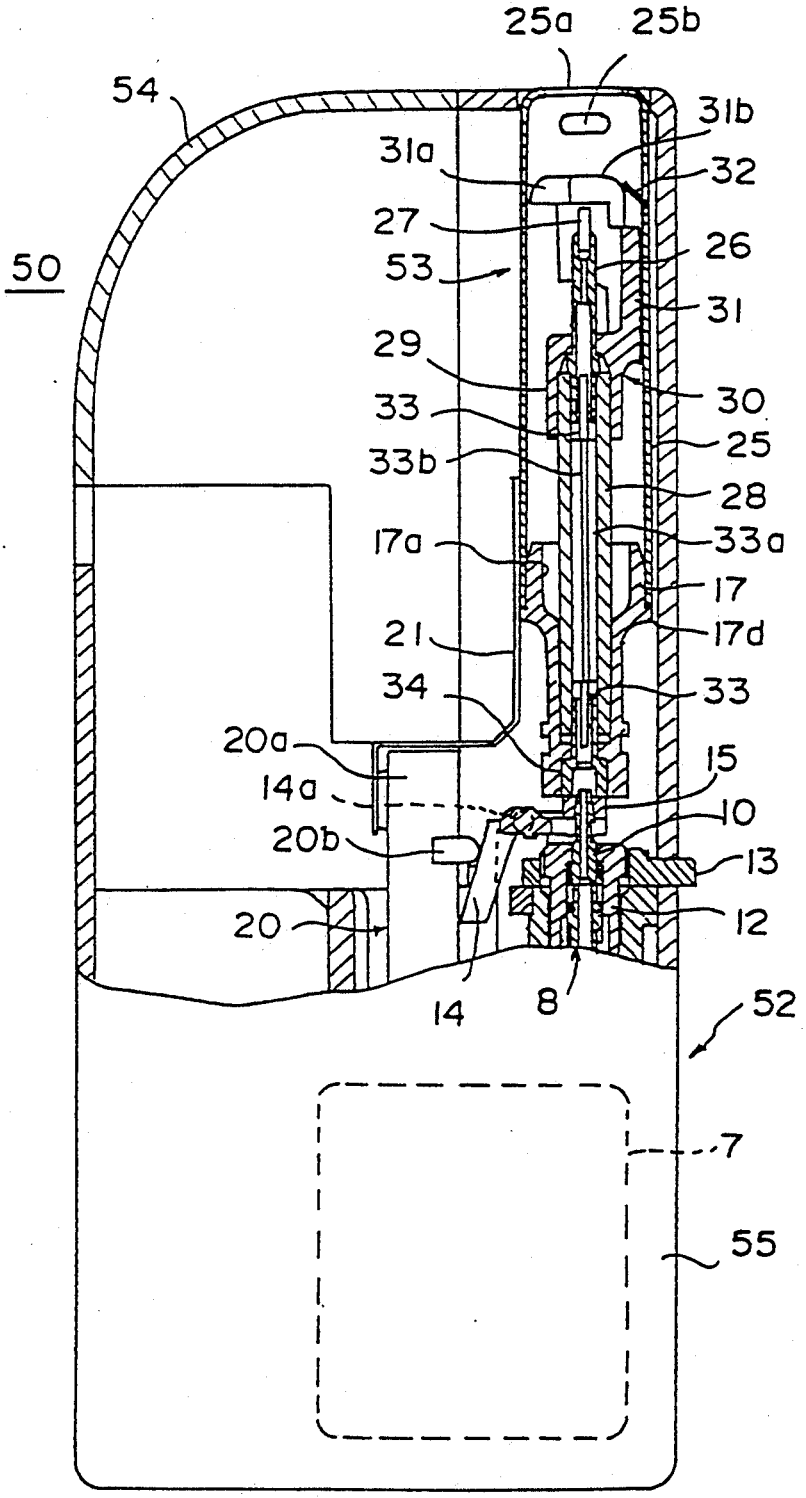
FIG. 5 is a side view partly in cross-section showing an igniting device in accordance with another embodiment of the present invention.

FIG. 5 shows another embodiment of the present invention in the form of a table gas lighter. The table gas lighter of this embodiment is basically the same as the igniting rod of the aforesaid embodiment, and accordingly the analogous parts are given the same reference numerals.

In the table gas lighter 50 of this embodiment, the casing portion 55 of the body portion 52 in which the valve mechanism 8 and the like are accommodated is shaped so that the lighter 50 can be erected. The gas reservoir 7 is shaped to conform to the shape of the casing portion 55. The ignition lever 54 for actuating the piezoelectric unit 20 provided in the body portion 52 is movable up and down, and the valve mechanism 8 is opened and the piezoelectric unit 20 is actuated to produce the discharge voltage in response to depression of the ignition lever 54. Further the igniting lever 54 forms an upper part of the casing portion 55.

Though the rod portion 53, i.e., the tubular member 25 and the gas pipe 28, is shorter than that of the aforesaid embodiment, the gas injection nozzle 26, the nozzle cover 30, the covered wire 33 and the like are the substantially same as in the aforesaid embodiment in shape and function.

We claim:

1. An igniting device comprising a gas reservoir for storing therein fuel gas, a valve mechanism which controls fuel supply from the gas reservoir, a gas pipe which is connected to the valve mechanism at one end and to a gas injection nozzle at the other end so that fuel gas supplied from the gas reservoir flows to the gas injection nozzle through the gas pipe without admixture of air, a piezoelectric unit for generating a discharge voltage between the gas injection nozzle and a discharge electrode disposed near the gas injection nozzle, an actuator for actuating both the valve mechanism and the piezoelectric unit, a wire which electrically connects the gas injection nozzle to the piezoelectric unit extending through the gas pipe, an insulating wire cover enclosing the wire and extending through the gas pipe and fitting closely therein to reduce substantially the effective cross-sectional area of the gas passage inside the gas pipe and assure high-velocity fuel flow therethrough, and a groove of substantially constant cross-sectional area extending in the surface of and along the length of the cover to assure an adequate flow of gas through the gas pipe.

2. An igniting device as defined in claim 1 in which said covered wire extends coaxially with the gas pipe, thereby minimizing the stray capacitance.

* * * * *

UNITED STATES PATENT AND TRADEMARK OFFICE

CERTIFICATE OF CORRECTION

PATENT NO. : 5,322,433

DATED : June 21, 1994

INVENTOR(S) : Tsutomu Shike et al.

It is certified that error appears in the above-identified patent and that said Letters Patent is hereby corrected as shown below:

On title page, item [56], "U.S. PATENT DOCUMENTS": The following cited prior art reference should be listed:

--5,123,837 6/1992 Farnham et al. ... 431/255X--.

Column 2, line 52: The words "i the" should read --in the--.

Signed and Sealed this

Twentieth Day of December, 1994

Attest:

Bruce Lehman

BRUCE LEHMAN

Attesting Officer

Commissioner of Patents and Trademarks